United States Patent [19]

McGowan

[11] Patent Number: 5,046,945

[45] Date of Patent: Sep. 10, 1991

[54] RESERVE FLAMMABLE GAS CONTAINER APPARATUS

[76] Inventor: Kevin J. McGowan, 475 Ashley Dr., Loganville, Ga. 30249

[21] Appl. No.: 529,533

[22] Filed: May 29, 1990

[51] Int. Cl.[5] ..... A44B 1/04

[52] U.S. Cl. ..... 431/344; 126/39 R; 222/6; 24/306; 24/442

[58] Field of Search ..... 431/344, 343; 126/39 R; 222/6, 3; 24/306, 442

[56] References Cited

U.S. PATENT DOCUMENTS

| | | | |
|---|---|---|---|
| 2,172,863 | 9/1939 | Buttner | 222/6 |
| 2,176,580 | 10/1939 | Buttner | 222/6 |
| 3,383,738 | 5/1968 | Fox et al. | 24/306 |
| 3,650,405 | 3/1972 | Morrison | 222/6 |
| 3,947,927 | 4/1976 | Rosenthal | 24/306 |
| 4,545,759 | 10/1985 | Giles et al. | 431/344 |
| 4,893,381 | 1/1990 | Frankel | 24/442 |

*Primary Examiner*—Carroll B. Dority
*Attorney, Agent, or Firm*—Leon Gilden

[57] ABSTRACT

An apparatus including a primary and secondary flammable gas container, wherein the flammable gas container is arranged for use during depletion of flammable gas within the primary container. The apparatus further includes a coupling member mounted to the secondary gas container cooperative to direct flammable gas to a desired appliance.

1 Claim, 4 Drawing Sheets

PRIOR ART

RESERVE FLAMMABLE GAS CONTAINER APPARATUS

BACKGROUND OF THE INVENTION

1. Field of the Invention

The field of invention relates to flammable gas delivery apparatus, and more particularly pertains to a new and improved reserve flammable gas container apparatus wherein the same arranges a reserve flammable gas tank for use upon depletion of a primary gas container or reservoir.

2. Description of the Prior Art

Various appliances such as gas grills, torches, and the like utilize a portable flammable gas supply, such as propane, to effect a desired purpose, such as heating and the like. Upon depletion of a gas supply from a container, an associated gas appliance is rendered inoperative and the bulky and awkward construction of such primary gas containers frequently discourages the use and availability of reserve supplies. The instant invention attempts to overcome deficiencies of the prior art by utilizing a secondary gas container of a lesser dimensional configuration than a primary gas container and permit association therewith to provide a backup supply of such flammable gas as is typically utilized.

Examples of the prior art include U.S. Pat. No. 4,779,608 to Smith illustrating the use of a flammable gas container directing an associated gas charge into a "T" shaped manifold structure to underlie an associated fireplace to assist in ignition of the fireplace components.

U.S. Pat. No. 4,759,339 to Hefling provides a single-burner stove wherein the stove is securable in a coaxially aligned relationship relative to an underlying propane bottle.

U.S. Pat. No. 4,738,242 to Hart provides for a door lock defroster wherein a propane bottle cooperative through a flexible hose directs a heating flame into the lock structure between an automotive door and associated framework.

U.S. Pat. No. 4,804,324 to Yoshinaga utilizes an organization wherein the burner device accommodates liquefied gas cylinders or fuel tanks of different mounting cap configurations.

U.S. Pat. No. 4,791,538 to Prest utilizes a single coupler, wherein three rigid fuel tanks are mounted and provide a tripod support for a coaxially aligned and overlying lantern.

As such, it may be appreciated that there continues to be a need for a new and improved reserve flammable gas container apparatus wherein the same addresses both the problems of ease of use, as well as effectiveness in providing immediate application of reserve fuel to a gas appliance from a reserve fuel tank supply and in this respect, the present invention substantially fulfills this need.

SUMMARY OF THE INVENTION

In view of the foregoing disadvantages inherent in the known types of fuel tank supply apparatus now present in the prior art, the present invention provides a reserve flammable gas container apparatus wherein the same permits fluid communication on a selective basis from a reserve gas container to an associated gas appliance. As such, the general purpose of the present invention, which will be described subsequently in greater detail, is to provide a new and improved reserve flammable gas container apparatus which has all the advantages of the prior art flammable gas delivery apparatus and none of the disadvantages.

To attain this, the present invention provides an apparatus including a primary and secondary flammable gas container, wherein the flammable gas container is arranged for use during depletion of flammable gas within the primary container. The apparatus further includes a coupling member mounted to the secondary gas container cooperative to direct flammable gas to a desired appliance.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved reserve flammable gas container apparatus which has all the advantages of the prior art flammable gas delivery apparatus and none of the disadvantages.

It is another object of the present invention to provide a new and improved reserve flammable gas container apparatus which may be easily and efficiently manufactured and marketed.

It is a further object of the present invention to provide a new and improved reserve flammable gas container apparatus which is of a durable and reliable construction.

An even further object of the present invention is to provide a new and improved reserve flammable gas container apparatus which is susceptible of a low cost of manufacture with regard to both materials and labor, and which accordingly is then susceptible of low prices of sale to the consuming public, thereby making such reserve flammable gas container apparatus economically available to the buying public.

Still yet another object of the present invention is to provide a new and improved reserve flammable gas container apparatus which provides in the apparatuses and methods of the prior art some of the advantages thereof, while simultaneously overcoming some of the disadvantages normally associated therewith.

Still another object of the present invention is to provide a new and improved reserve flammable gas container apparatus wherein the same permits selective directing of a reserve flammable gas fuel supply from a reserve container and provides effective and safe association of a primary and secondary flammable gas supply.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
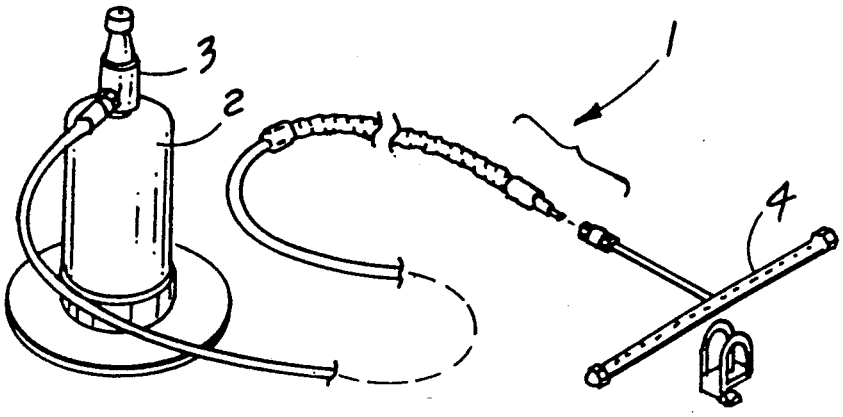
FIG. 1 is an isometric illustration of a prior art flammable gas delivery apparatus.

With reference now to the drawings, and in particular to FIGS. 1 to 8 thereof, a new and improved reserve flammable gas container apparatus embodying the principles and concepts of the present invention and generally designated by the reference numeral 10 will be described.

Figure 2:
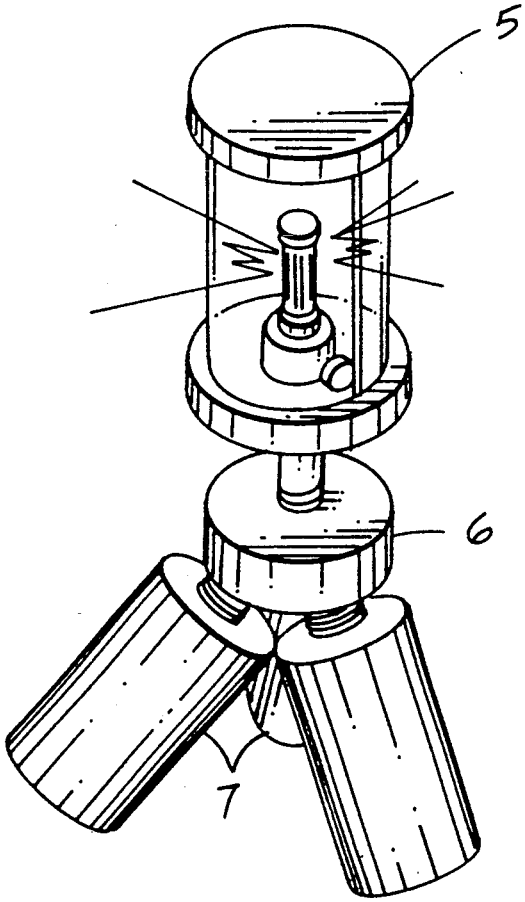
PRIOR ART FIG 2
FIG. 2 is an isometric illustration of a further example of a prior art flammable gas delivery apparatus.
Figure 3:
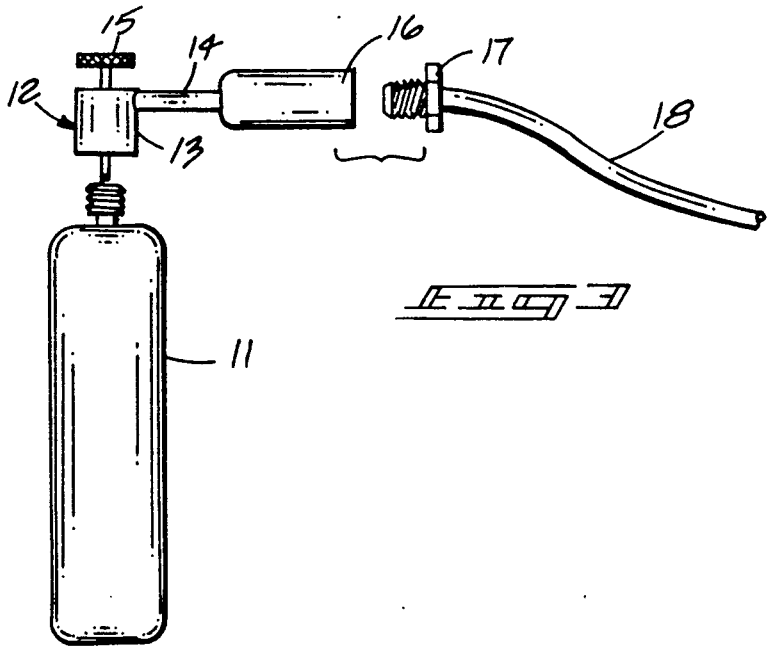
FIG. 3 is an orthographic view taken in elevation of the coupling head in association with a reserve flammable gas container.

FIG. 1 illustrates a prior art flammable gas delivery apparatus 1, wherein a container 2 directs gas through a valving 3 to an associated "T" shaped manifold 4. FIG. 2 illustrates a further prior art gas delivery apparatus wherein a lantern 5 is coaxially mounted to an underlying coupling 6 which receives a trio of gas cylinders 7 that perform a dual function as a tripod support during use of the apparatus.

Figure 4:
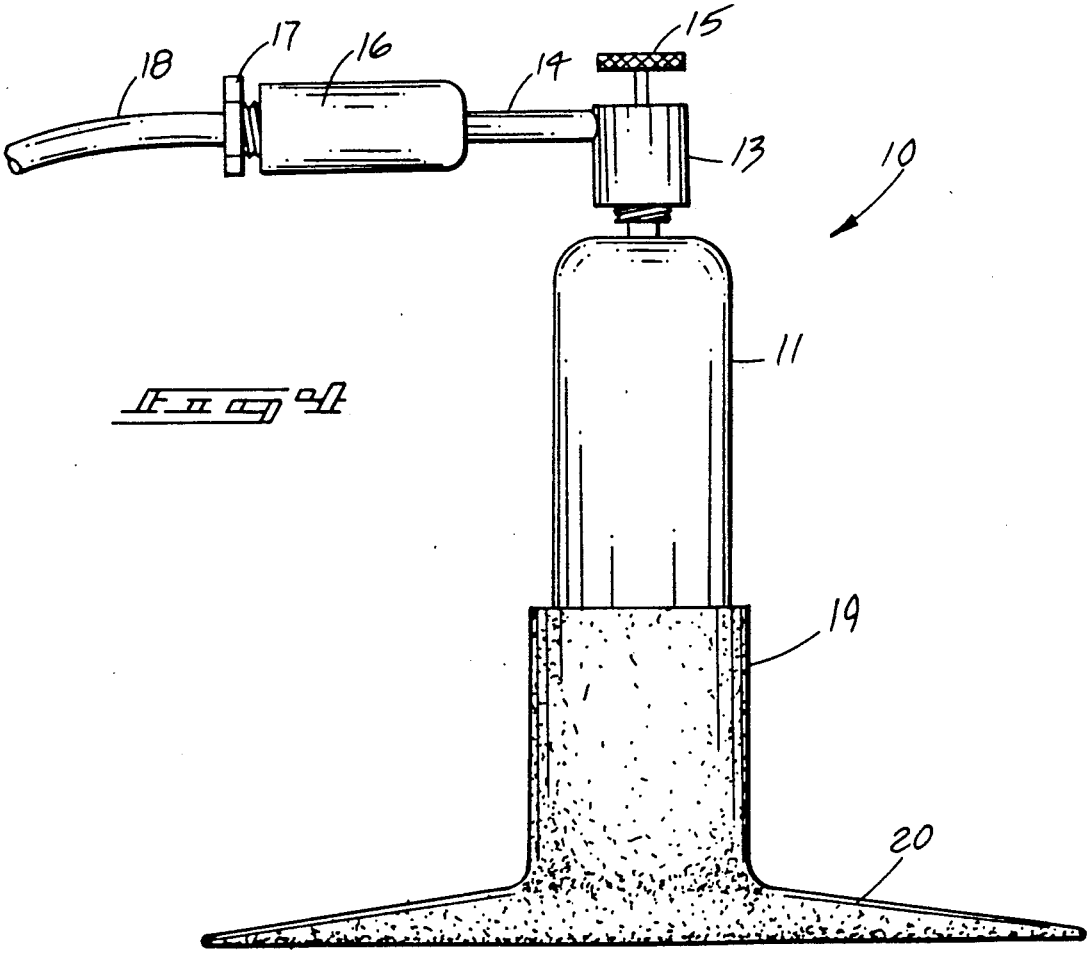
FIG. 4 is an orthographic view taken in elevation of the reserve flammable gas container and associated coupling mounted within a support member.
Figure 5:
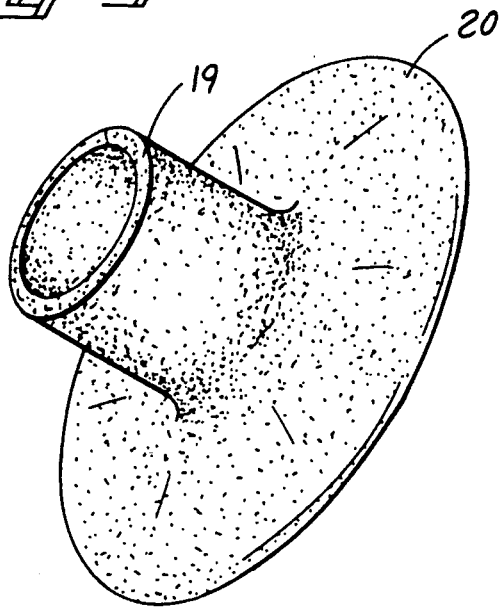
FIG. 5 is an isometric illustration of the support member, as illustrated in FIG. 4.

More specifically, the reserve flammable gas container apparatus 10 of the instant invention essentially comprises a first pressurized flammable gas container 11 defined by a first diameter, with a coupling head 12 threadedly mounted onto an upper terminal end of the first gas container 11. The coupling head 12 includes a first threaded socket 13 threadedly receiving the upper terminal end of the container 11, with a coupling head supply conduit 14 orthogonally oriented relative to the coupling head 12, and directing and fluidly mounted to an associated second internally threaded socket 16. The conduit 14 positions the socket 16 in a spaced relationship to the container 11, wherein potential rupturing of an associated first appliance conduit 18 mounted to the second socket 16 by a coupling member 17 positions any potential flame in a spaced relationship relative to the container 11. A valve handle 15 selectively directs the pressurized fluid from the container 11 through the coupling head supply conduit 14 into the second socket 16. FIG. 4 illustrates the invention utilizing a resilient cylindrical sleeve 19 defined by an internal diameter equal to the first diameter defined by the first pressurized gas container to frictionally and securably receive the gas container 11 therewithin. The sleeve 19 is orthogonally oriented relative to a resilient pedestal base 20, wherein the pedestal base 20 is defined by a pedestal diameter substantially greater than that defined by the sleeve 19 to provide stability in positioning the first container 11 relative to a gas appliance through the first appliance conduit 18.

Figure 6:
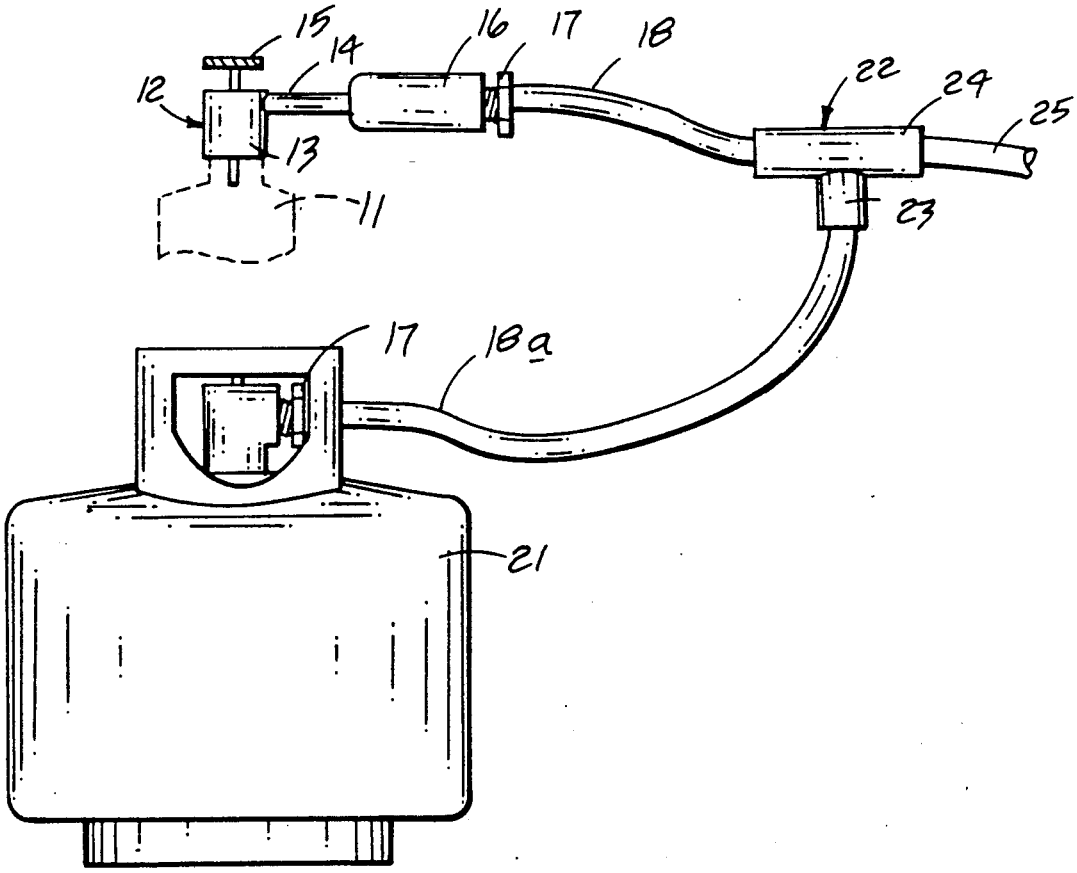
FIG. 6 is an orthographic side view taken in elevation of a primary and secondary flammable gas supply container operatively used by the instant invention.

FIG. 6 illustrates the coupling head 12 and associated first container 11 cooperative with a second pressurized flammable gas container 21. The second container 21 is defined by a second diameter substantially greater than that defined by the first diameter of the first container. A coupling member 17 operatively associates a second appliance conduit **18*a* to the second container 21. The second appliance conduit 18*a* and the first appliance conduit 18 are each mounted integrally and in fluid communication with a "T" shaped junction 22. The "T" shaped junction 22 includes a first junction conduit 23 to receive the second appliance conduit 18*a* and a second junction conduit 24 to receive the first appliance conduit 18. A main appliance supply conduit 25 is mounted to a remaining leg of the "T" shaped junction 22 to direct gas supply selectively from either the first or second cylinders 11 or 21** to an associated gas appliance.

Figure 7:
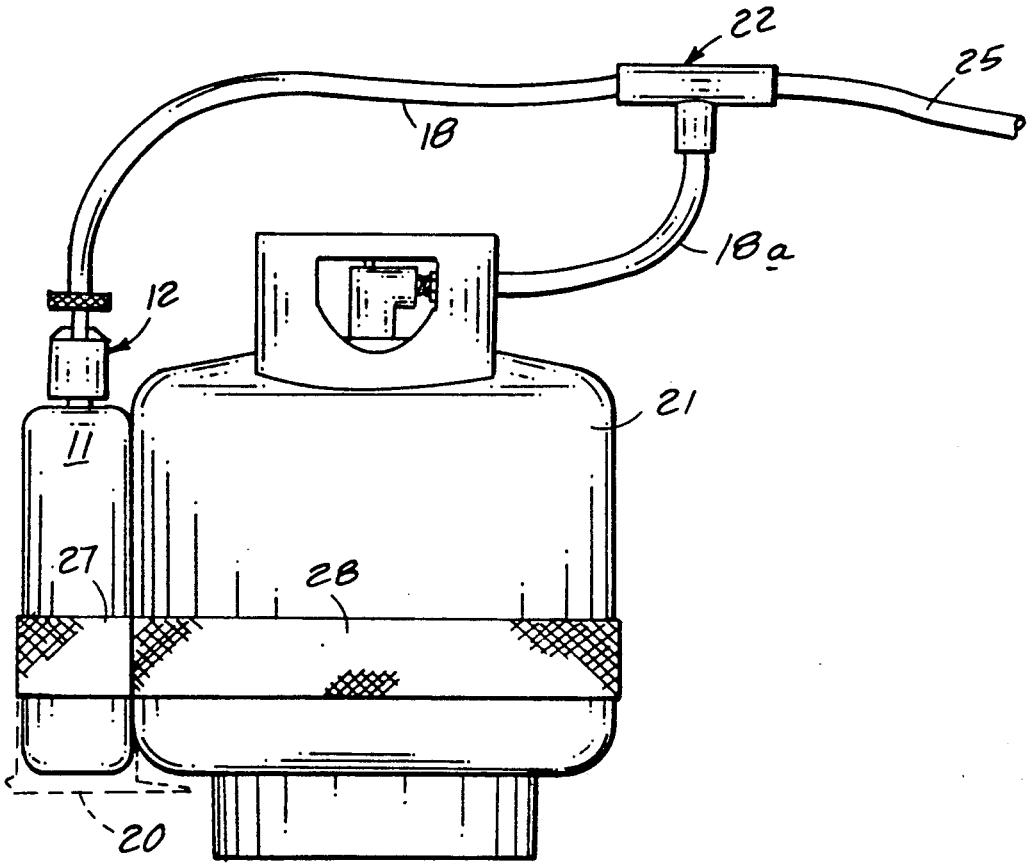
FIG. 7 is an orthographic side view taken in elevation of the primary and secondary supply container secured together in a convenient and effective association.
Figure 8:
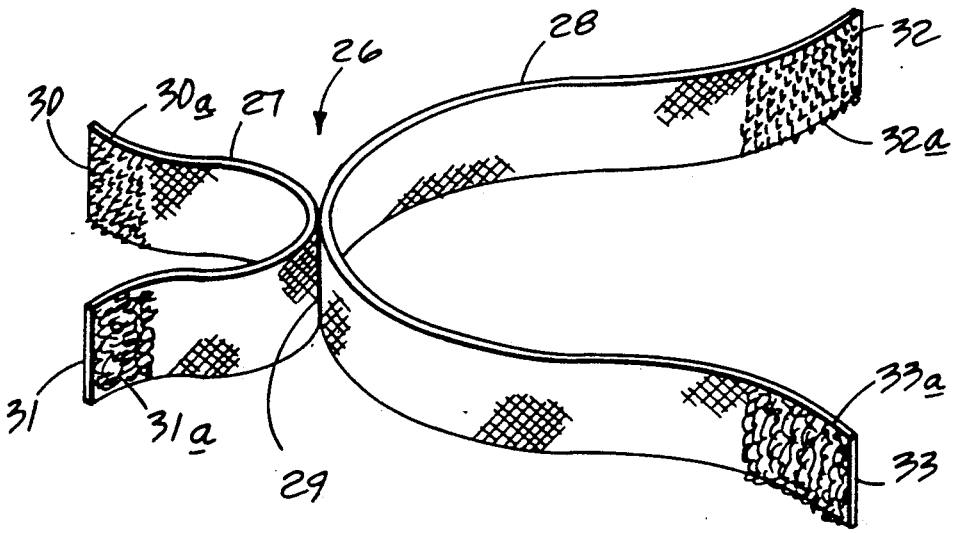
FIG. 8 is an isometric illustration of the junction strap utilized to secure the primary and secondary gas containers together.

FIG. 7 illustrates the use of a junction strap 26 to mount the first gas container 11 to the second gas container 21. The junction strap includes a first flexible belt 27 defined by a first length integrally mounted to a second flexible belt 28 defined by a second length, wherein the second length is essentially greater than that of the first length. The first flexible belt 27 is integrally joined to the second flexible belt 28 at a connector line 29 positioned medially of each rear surface of each flexible belt to ensure the belt back-to-back relationship relative to one another, as illustrated in FIG. 8. The first flexible belt 27 is securable about the first container 11, while the second belt 28 is securable about the second container 21 to secure the containers in a side-by-side relationship for convenience of storage and portability in use. The first belt 27 includes a respective first and second belt terminal end 30 and 31. A first hook and loop fastener patch is mounted to an interior surface of the first belt adjacent the first terminal end 30, while a second first belt hook and loop fastener patch **31*a* is mounted on an exterior surface of a the first belt adjacent the second terminal end 31. Similarly, the second belt includes a second belt first and second terminal end 32 and 33 respectively, with a first hook and loop fastener patch 32*a* mounted to an interior surface of the second belt adjacent the first terminal end, wherein a second hook and loop fastener patch 33***a* is mounted to an exterior surface of the second belt adjacent the second terminal end 33 of the second belt.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

It is further contemplated that the scope of the instant invention includes a unitary L.P. (liquid petroleum) tank adapted for securement to the regulator of air associated barbeque grill and the like in a manner as noted above.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A reserve flammable gas container apparatus comprising, in combination, a first flammable gas container defined by a first diameter, the gas container including an upper externally threaded end, and a coupling head including a first internally threaded socket threadedly receiving the upper threaded terminal end of the first gas container therewithin, and the first threaded socket including an orthogonally and integrally mounted coupling head supply conduit in fluid communication with the first internally threaded socket and defined by a predetermined length to extend beyond the first container, and a second internally threaded socket in alignment and in fluid communication with the coupling head supply conduit, and the second internally threaded socket threadedly receiving a first appliance conduit therewithin to direct flammable gas from the first gas container to a gas appliance, and wherein the coupling head includes a manually manipulable valve handle to selectively limit gas flow from the first gas container to the coupling head supply conduit, and further including a second gas container, the second gas container defined by a second diameter substantially greater than that defined by the first diameter, and the second gas container including a second appliance conduit in fluid communication with the second gas container, and a "T" shaped junction, the "T" shaped junction including a first conduit and second conduit, the first conduit receiving the second appliance conduit and the second conduit receiving the first appliance conduit, and a main appliance conduit in fluid communication with the "T" shaped junction, wherein the first appliance conduit, the second appliance conduit and the main appliance conduit are in sealed integrally secured association with the "T" shaped junction, and further including a junction strap, the junction strap including a first flexible strap and a second flexible strap secured together, and the first gas container is secured only within said first flexible strap, and the second gas container is secured only within the second flexible strap to secure the first and second gas container together in a side-by-side relationship, and wherein the first flexible strap is defined by a first length and the second flexible strap is defined by second length, and the first length is substantially less than that of the second length, and wherein the first and second flexible straps are secured together medially of each of the respective first and second length of each respective first and second flexible strap at a connection line formed on each rear surface of each respective first and second flexible strap medially of each first and second flexible strap, and wherein the first flexible strap includes a first and second hook and loop fastener patch formed adjacent a respective first and second terminal end of the first flexible strap, and the first hook and loop fastener patches formed on an interior surface of the first flexible strap adjacent the first terminal end of the first junction strap, and the second hook and loop fastener patch is mounted to an exterior surface of the first flexible strap adjacent the second terminal end of the first flexible strap, and the second flexible strap includes a respective second flexible strap first and second terminal end, wherein the first terminal end includes a second strap first hook and loop fastener patch formed on an interior surface of the second flexible strap adjacent the first terminal end of the second flexible strap, and a second flexible strap second hook and loop fastener patch formed adjacent the second flexible strap second terminal end on an exterior surface of the second flexible strap, wherein the respective first and second hook and loop fastener patches of each respective first and second flexible strap permit selective securement and association of the first and second gas container within the respective first and second flexible strap.

* * * * *